United States Patent [19]

Jaffa et al.

[11] 4,389,936

[45] Jun. 28, 1983

[54] CLEANING ATTACHMENT FOR SCREEN PRINTER

[75] Inventors: David Jaffa; Sandor Szarka, both of Franklin Lakes, N.J.

[73] Assignee: Precision Screen Machines, Inc., Hawthorne, N.J.

[21] Appl. No.: 207,884

[22] Filed: Nov. 18, 1980

[51] Int. Cl.[3] ..... B41F 35/00; B41L 41/00

[52] U.S. Cl. ..... 101/123; 15/102; 15/246; 101/425

[58] Field of Search ..... 101/425, 123; 15/97 R, 15/102, 246

[56] References Cited

U.S. PATENT DOCUMENTS

| | | | |
|---|---|---|---|
| 1,270,351 | 6/1918 | White | 101/425 |
| 1,616,556 | 2/1927 | Smith | 101/425 |
| 3,735,702 | 5/1973 | Kossak | 101/425 |
| 3,900,003 | 8/1975 | Sato | 101/425 |
| 4,016,812 | 4/1977 | Lauk | 101/425 |
| 4,135,448 | 1/1979 | Moestue | 101/425 |

FOREIGN PATENT DOCUMENTS

| | | | |
|---|---|---|---|
| 1081480 | 5/1960 | Fed. Rep. of Germany | 101/425 |
| 2054442 | 5/1972 | Fed. Rep. of Germany | 101/425 |
| 2528261 | 5/1976 | Fed. Rep. of Germany | 101/425 |
| 55-2041 | 1/1980 | Japan | 101/425 |
| 1522069 | 8/1978 | United Kingdom | 101/425 |

*Primary Examiner*—Clyde I. Coughenour

*Attorney, Agent, or Firm*—Weingram & Klauber

[57] ABSTRACT

An apparatus for over the edge printing including a printing squeegee which forces ink through clear portions of a printing screen onto a workpiece. Excess ink which is forced through clear portions of the printing screen and which extend over the edge of the workpiece, are cleaned by a cleaning assembly which includes a cleaning belt. The cleaning belt is unrolled below the printing screen and an excess ink squeegee prints the excess ink onto the cleaning belt which is then cleaned and re-rolled and the apparatus is made ready for the next printing stroke.

15 Claims, 14 Drawing Figures

FIG. 6
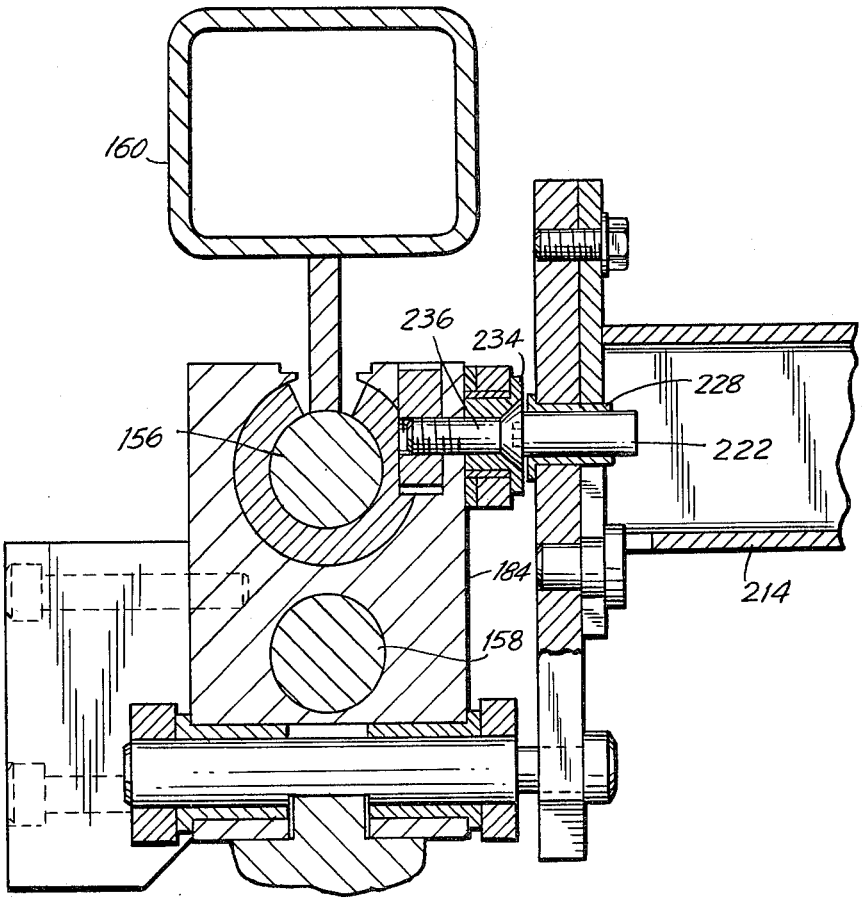
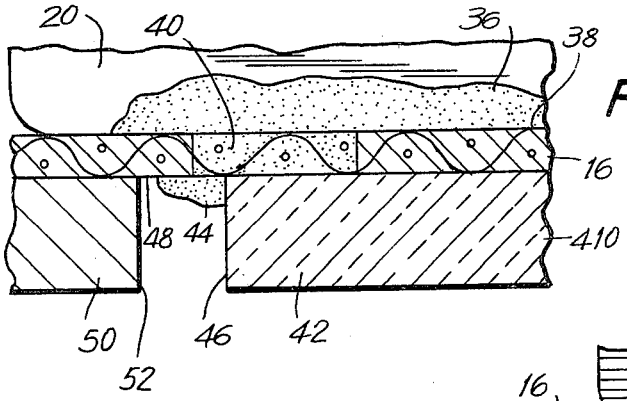
FIG. 7
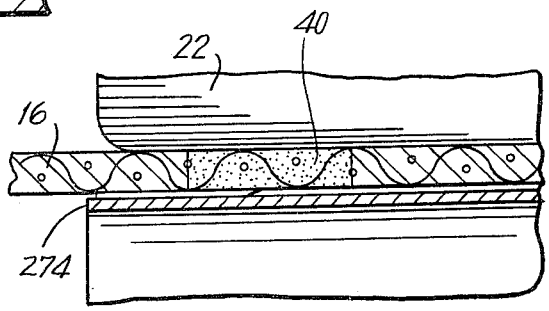
FIG. 8

CLEANING ATTACHMENT FOR SCREEN PRINTER

BACKGROUND OF THE INVENTION

The present invention relates to an apparatus for over the edge printing.

There is a long felt need in the field of printing equipment for an apparatus which can perform over the edge screen printing of objects in an efficient and cost effective manner. When over the edge printing is attempted using conventional screen printing equipment, the pattern or open portion of the screen, through which printing ink can pass, is configured so that it extends beyond the workpiece or object to be printed. This is done in order to accommodate the various tolerances which are present and which include the manufacturing tolerances of the workpiece as well as that of the printing screen, and the positioning tolerances of the workpiece with respect to the printing press. When ink is applied to the top surface of the printing screen and forced through the open portion thereof, the ink on those open portions of the screen which extend beyond the workpiece tend to coat the bottom surface of the screen and the support surface below. This results in unwanted smudging of the items being printed, with resultant waste of materials and loss of productive time.

Conventional expedients, such as extremely careful manufacture of the printing screens to ensure that the open areas line up exactly with the items being printed and also ensure that the printing screens do not extend over the edges of the items, are extremely costly and are not practical for volume production applications.

OBJECTS OF THE INVENTION

It is a primary object of the present invention to provide an apparatus for over the edge printing capable of sustained operation at a high rate of production.

It is another object of the present invention to provide an apparatus for over the edge printing which is capable of printing on virtually any flat or substantially flat workpiece.

It is a further object of the present invention to provide an apparatus of the foregoing type for over the edge printing which includes a cleaning assembly which cleans the printing screen between printing strokes.

It is yet another object of the present invention to provide an efficient and economical method for over the edge screen printing.

It is still a further object of the present invention to provide an apparatus for over the edge printing which comprises a relatively small number of component parts which are economical of manufacture.

SUMMARY OF THE INVENTION

In accordance with the present invention, there is provided a method and an apparatus for over the edge printing. The apparatus includes a printing carriage assembly which is mounted on guide rails on a printing frame. The frame includes a chain drive for driving the printing carriage assembly transversely across the frame and a printing screen. The printing carriage assembly includes a floodbar, a printing squeegee and an excess ink squeegee. A transfer mechanism brings a workpiece beneath the printing screen, after which the printing carriage assembly traverses across the frame while the printing squeegee forces ink through open portions of the printing screen onto the workpiece. The transfer mechanism moves the workpiece outwardly from under the printing screen concomitantly with a cleaning stroke, during which the excess ink squeegee prints excess ink, which has collected on the bottom surface of the printing screen, onto a cleaning belt which has been unrolled below said printing screen.

As the printing carriage moves across the printing screen during the cleaning stroke, the cleaning belt is re-wound onto a roller. The apparatus includes a cleaning assembly which cleans the belt while it is being unrolled and re-rolled. At the end of the cleaning stroke, the belt is rewound onto the roller, a new workpiece is brought into position under the printing screen and the apparatus is ready for a new printing stroke.

In accordance with the present invention, there is also provided a method for over the edge printing which includes the steps of providing a printing screen having selected clear portions which extend past the edge of a workpiece, positioning a workpiece beneath the printing screen, inking the screen and forcing the ink through the printing screen onto the workpiece, peeling the screen away from the workpiece and removing the workpiece, unrolling a cleaning belt below the printing screen and forcing the excess ink from the underside of the printing screen to print onto the cleaning belt and cleaning and re-rolling the cleaning belt.

BRIEF DESCRIPTION OF THE DRAWINGS

The foregong and other objects, features and advantages of the present invention will become readily apparent to those skilled in the art from the detailed description hereinafter, considered in conjunction with the accompanying drawings, wherein:

FIG. 6 is a transverse cross sectional view taken along the line 6—6 of FIG. 4;

FIG. 7 is a fragmentary cross sectional view of a portion of the printing screen of the apparatus of FIG. 1 with the screen shown in the process of printing over the edge of a workpiece;

FIG. 8 is a fragmentary cross sectional view, similar to FIG. 7, showing the printing workpiece removed and showing a cleaning belt in position below the printing screen for the purpose of cleaning the lower surface of the screen in accordance with the present invention;

DETAILED DESCRIPTION OF PREFERRED EMBODIMENTS

Figure 1:
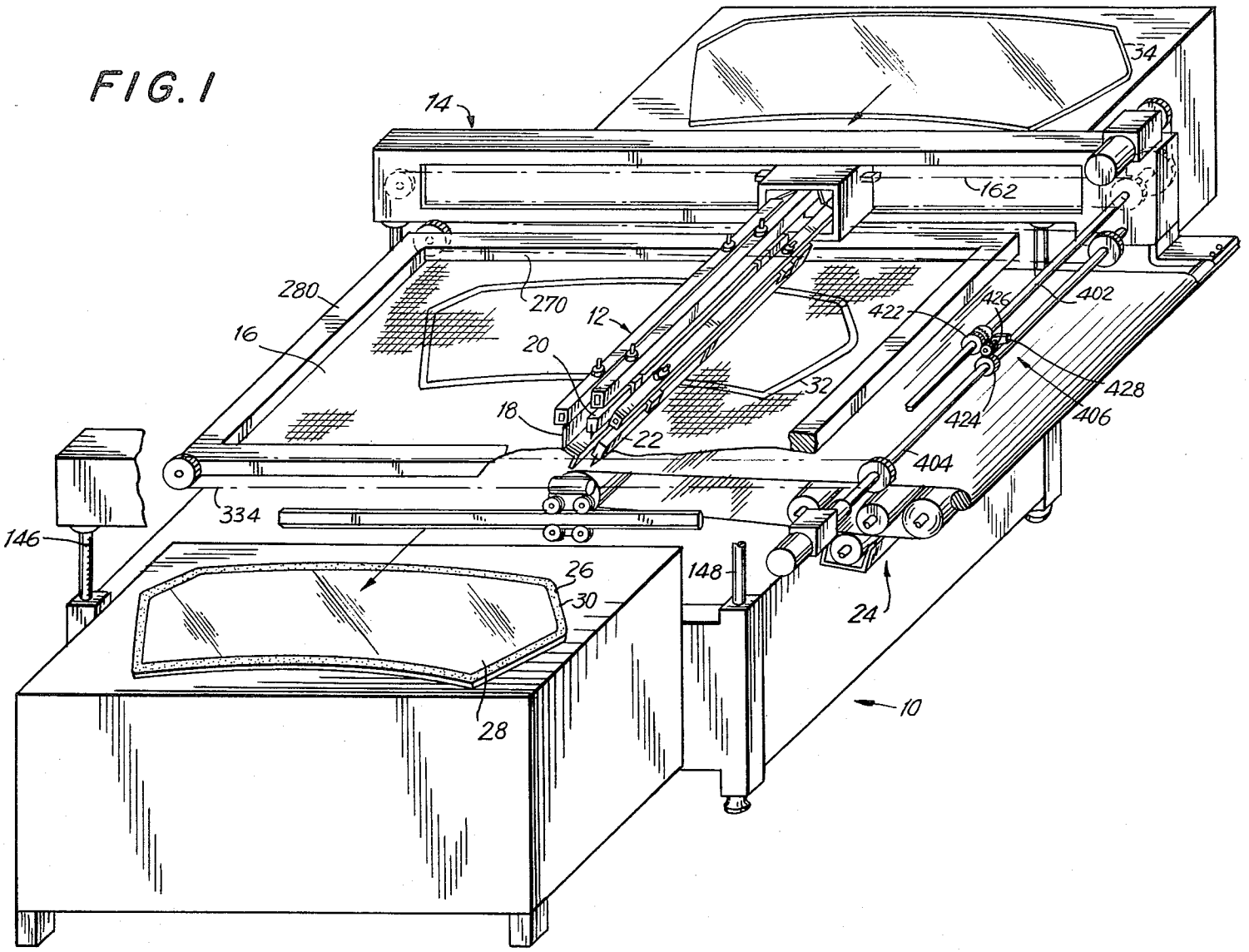
FIG. 1 is an overall perspective view of an apparatus for over the edge printing, in accordance with the present invention, with the apparatus shown in use and with portions of the apparatus shown broken away to reveal internal details of construction.

With reference to FIG. 1 there is shown an overall perspective view of an apparatus for over the edge printing 10, constructed in accordance with the present invention. The apparatus comprises a printing carriage assembly 12 which is mounted in a printing frame 14, and a printing screen 16. The printing carriage assembly 12 includes a floodbar 18, a printing squeegee 20 and an excess ink squeegee 22. A portion of the printing screen 16 is shown broken away to reveal a cleaning belt assembly 24 which cooperates with the printing carriage assembly 12 to clean the printing screen 16, in a manner which will be presently described and which forms a major novel feature of the present invention.

The apparatus 10 in FIG. 1 is depicted, for purposes of illustration, in the process of printing an opaque border 26 on a glass automotive windshield 28. This opaque border 26 is both decorative and utilitarian in that it masks the sealing materials used to form a waterproof joint during the installation of the windshield into an automobile body. As illustrated in FIG. 1, the printed border 26 of the windshield 28 extends to the edge 30 of the glass. The open area 32, or printing area of the printing screen 16 must, in order to accommodate manufacturing tolerances of the glass blanks 34 and the positioning tolerances of the apparatus 10, extend beyond the edge of the glass blank in order to ensure that the printing extends to the edge of the glass; hence, the necessity for over the edge printing. An enlarged cross sectional view of the printing screen and the edge of an object being printed is shown in FIG. 7.

Referring now to FIG. 7, during the printing stroke a quanity of ink 36, which has been deposited on the upper surface 38 of the printing screen 16, is forced to flow through the open portion 40 of the screen 16 by the printing squeegee 20. A portion of this ink 36 flows onto the workpiece 42 forming the border 26 and a portion 44 of the ink 36 flows through the open portion 40 of the screen 16, which extends beyond the edge 46 of the workpiece 42 and collects on the underside 48 of the printing screen 16. The apparatus 10, according to the present invention, is directed toward the elimination of the problem caused by the ink portion 44 which collects on the underside 48 of the printing screen 16.

The portion of the printing screen 16 which extends beyond the edge 46 of the workpiece 42 is supported by a nest member 50 which is substantially equal in thickness to the workpiece 42. The edge 52 of the nest member 50 conforms generally to the configuration of the edge 46 of the workpiece 42. An optimum separation between the edge 52 of the nest member 50 and the edge 46 of the workpiece 42 has been found to be in the order of one-eighth ($\frac{1}{8}$) of an inch. The nest member 50 provides support for the screen 16 and prevents the downward force of the printing squeegee 20 and the excess ink squeegee 22 from bending the printing screen 16 about the edge 46 of the workpiece which would cause excessive wear of the screen.

The overall construction and operation of the apparatus 10 will be described with reference to FIG. 1, FIG. 2 and FIG. 3. The apparatus 10, in addition to the previously mentioned printing carriage assembly 12 and cleaning belt 24, includes a workpiece transfer assembly 54 which serves to move the glass blanks 34, one at a time, to a position beneath the printing carriage assembly 12. It is in this position that the blanks 34 are printed upon and then moved outwardly from under the printing carriage assembly 12.

The workpiece transfer assembly 54 is described by way of example only, it being obvious that alternative workpiece transfer devices, such as a printing belt or endless belt conveyor, may be utilized in alternative embodiments of the invention. In an additional alternative embodiment of the invention, the workpiece transfer assembly 54 may be eliminated completely and the workpieces may be manually positioned for printing below the printing carriage 12 and then manually removed.

During the operation of the apparatus 10, the workpiece transfer assembly 54 operates in the following manner: a glass blank 56 is placed onto a first transfer table 58 on top of a pair of transfer rails 60, 62, when viewed as in FIG. 2, and is positioned by means of the locators 64, 66, 68, 70. The transfer rails 60, 62 lift and move the glass blank 56, in the direction shown by the arrows 72, 74 in FIG. 2, initially to the position shown in broken lines in FIG. 2. The printing stroke of the apparatus 10 is accomplished while the glass blank 56 is in the position shown by broken lines in FIG. 2. When the printing stroke has been completed, the transfer rails 60, 62 again lift and move the printed glass blank 56 to the second transfer table 76 from where it is manually removed.

Figure 3A:
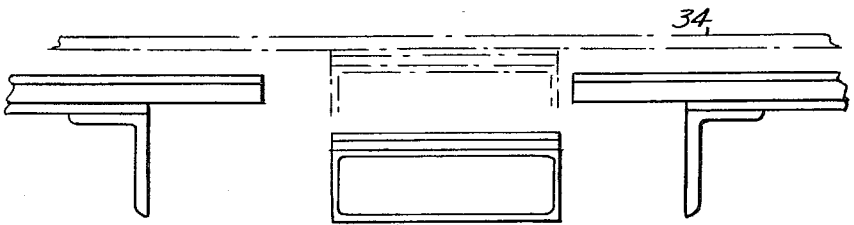
FIG. 3*a* is a fragmentary elevation view similar to FIG. 3 showing the raised position of the transfer assembly and the workpiece in broken line.
Figure 3:
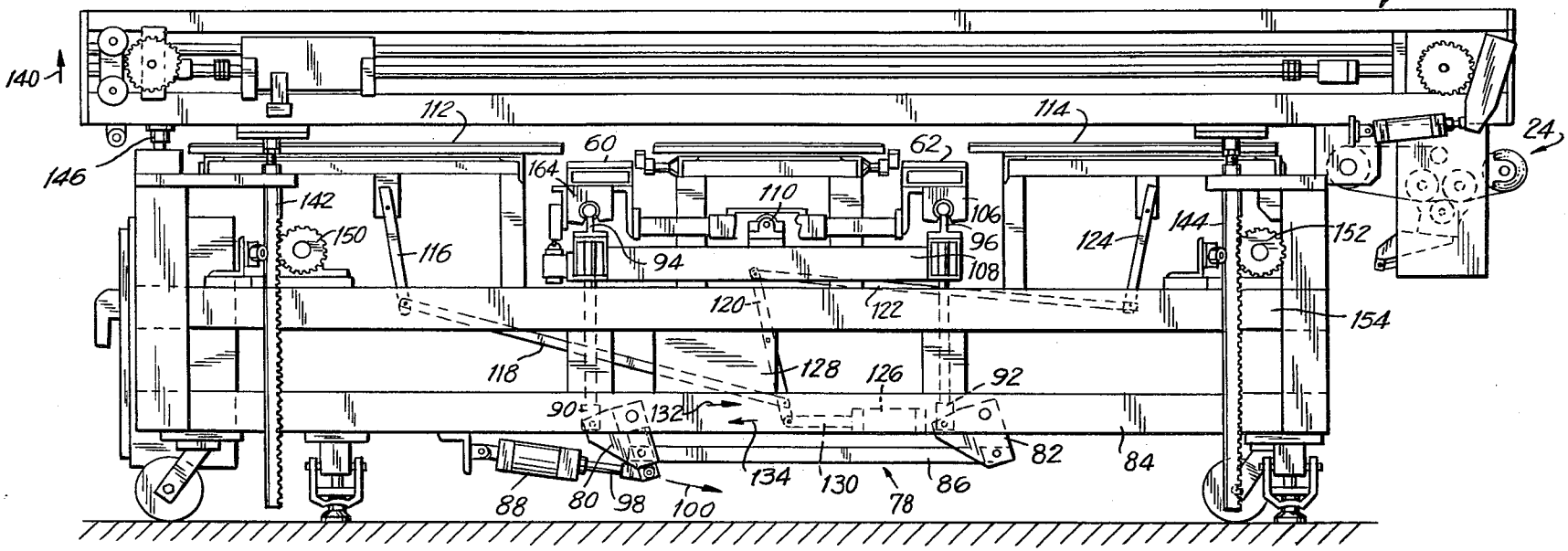
FIG. 3 is an elevation view of the apparatus of FIG. 1 taken along the line 3—3 of FIG. 2.

FIG. 3 shows the link mechanism 78 which lifts and lowers the transfer rails 60, 62. The link mechanism 78 includes a pair of pivot plates 80, 82 each pivotally mounted on the frame beam 84. The lower portions of the pivot plates 80, 82 are pivotally connected to the opposite ends of a link 86. The lower portion of the pivot plate 80 is also connected to an actuator 88 which is mounted on the frame beam 84. An upper portion of each of the pivot plates 80, 82, respectively, is pivotally connected to the lower ends of the links 90, 92, respectively, the upper ends of which links are connected to the guide members 94, 96, respectively. When the actuator shaft 98 is moved in the direction shown by the arrow 100, the pivot plates 80, 82 are rotated and cause the links 90, 92 to lower the transfer rails 60, 62. FIG. 3 shows the lowered position of the transfer rails 60, 62 and FIG. 3*a* diagramatically shows the transfer rails 60, 62 lifting a glass blank 34.

Figure 2:
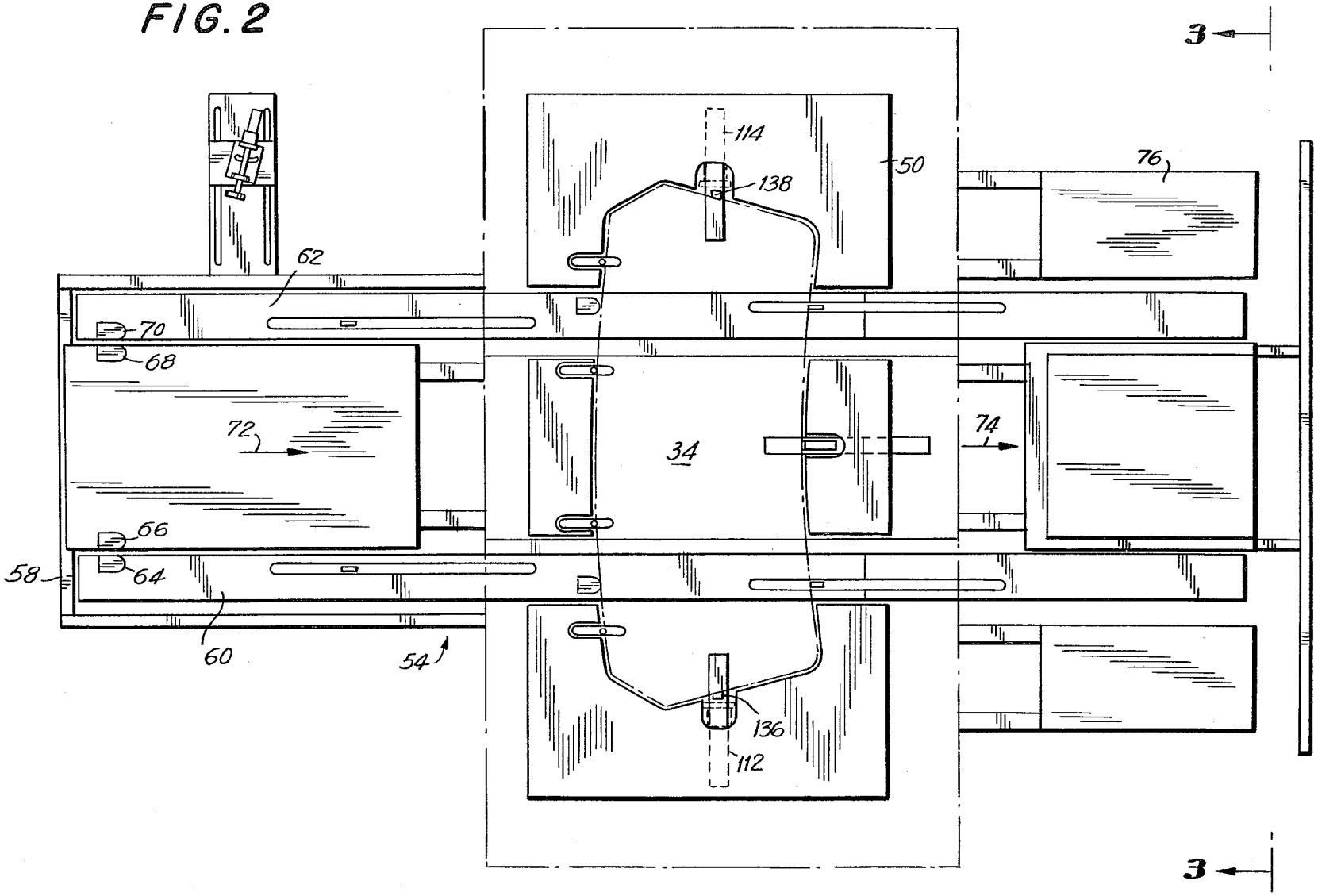
FIG. 2 is a plan view of the apparatus of FIG. 1.

The movement of the transfer rails 60, 60 in the direction shown by the arrows 72, 74 in FIG. 2 is accomplished by the guide ways 104, 106 which are formed in the transfer rails 60, 62, as shown in FIG. 3. The guide ways 104, 106 are supported by and slide on the guide members 94, 96 which are connected to the links 90, 92. The transfer rails 60, 62 are connected by means of a frame 108 which incorporates a hydraulic cylinder 110 which operates to move the frame 108 and the transfer rails 60, 62 in the direction indicated by the arrows 72, 74.

With further reference to FIGS. 2 and 3, the operation of the grippers 112, 114 is accomplished by the links 116, 118, 120, 122, 124 and the actuator 126. The center portion of the link 120 is pivotally connected to the frame plate 128, the upper end of the link 120 is pivotally connected to the upper end of link 122 and the lower end of the link 120 is connected to shaft 130 of the actuator 126, which is mounted on the frame beam 84. An intermediate portion of the link 120, proximate to the lower end, is pivotally connected to the lower end of the link 118. The upper end of link 118 is pivotally connected to the lower end of link 116, the upper end of which is pivotally connected to the gripper bar 112. The lower end of link 122 is pivotally connected to the lower end of the link 124, the upper end of which is pivotally connected to the gripper bar 114. When the shaft 130 of the actuator 126 moves in the direction shown by the arrow 132, the lower end of the link 120 moves to the right and the upper end moves to the left, thereby pulling the gripper bars 112, 114 toward each other and gripping the glass blank 34 which rests between the stop members 136, 138 on the gripper bars 112, 114, as illustrated by FIG. 2. When the actuator shaft 130 moves in the direction shown by the arrow 134, the gripper bars 112, 114 move away from each other, thereby releasing the glass blank 34.

FIG. 3 also shows the printing frame 14, on which the printing carriage 12 and the printing screen 16 are mounted. The printing frame 14 is movable in the vertical direction shown by the arrow 140, by means of rack members 142, 144 and guided by the guide rods 146, 148 which project downwardly from the lower portion of the printing frame 14. The rack members 142, 144 mesh with and are driven by the pinions 150, 152 which are mounted on the support frame 154.

The pinions 150, 152 may be driven by any one of a number of conventional drive elements such as air, hydraulic motors or chain drives in combination with air or hydraulic actuators.

The vertical movement of the printing frame 14 facilitates the movement of the cleaning belt assembly 24 under the printing screen 16 in a manner which will be described hereinafter.

The printing carriage 12 is supported and guided by the horizontal guide rods 156, 158 which are shown in detail in FIG. 6, wherein the upper guide rod 156 is mounted on the box beam 160 which forms a part of the printing frame 14. The printing carriage 12 is driven along the guide rods 156, 158 by a conventional machine drive element which may be in the nature of a chain drive 162 as indicated by the broken lines in FIG. 1.

Figure 4:
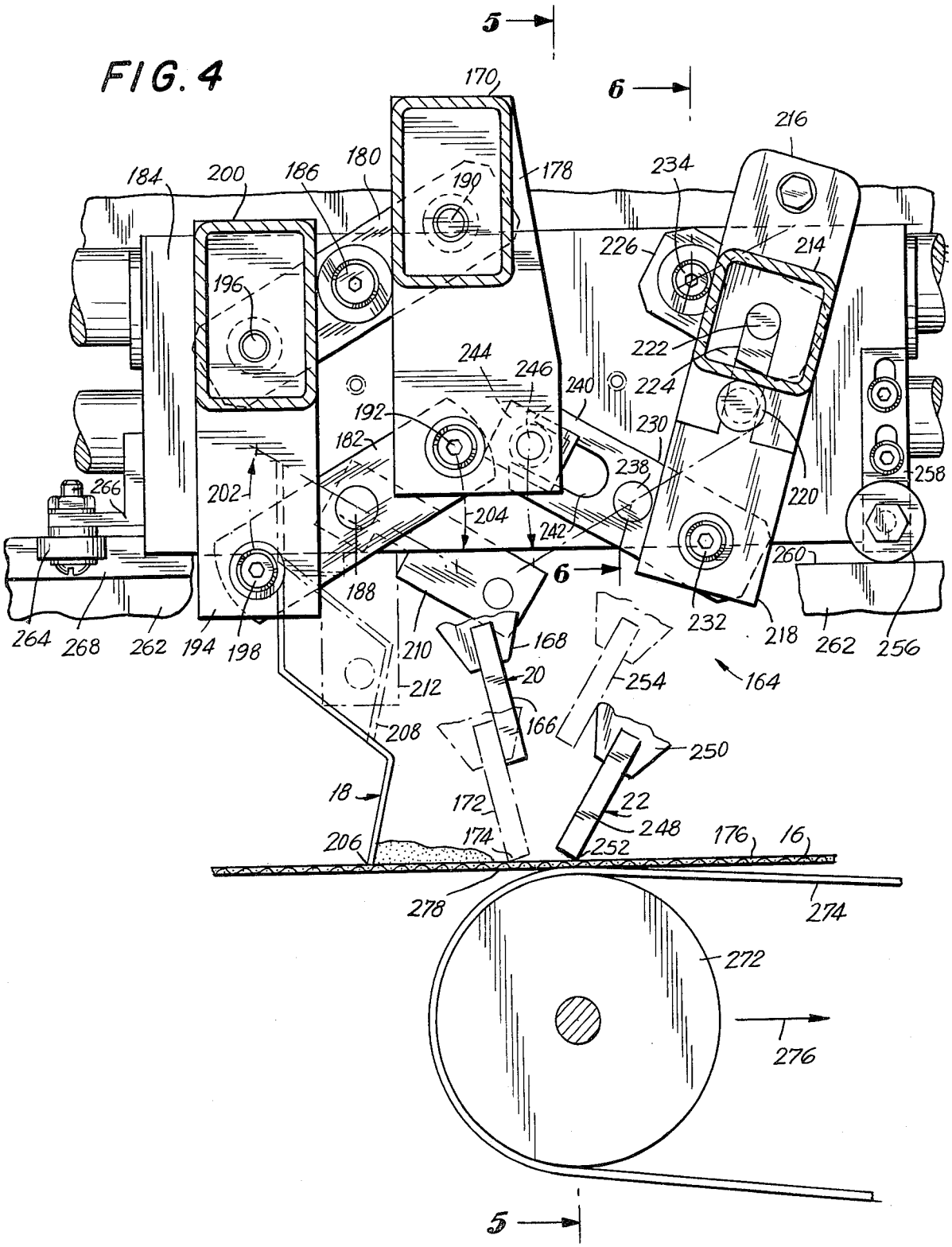
FIG. 4 is a fragmentary cross sectional view of the printing carriage assembly of the apparatus of FIG. 1 depicting alternative positions of the various elements, during the various operating sequences of the apparatus, shown in broken lines.

As more clearly illustrated in FIG. 4, the printing carriage 12 includes the printing squeegee 20, the excess ink squeegee 22, the floodbar 18 and an actuating mechanism 164 which raises and lowers the floodbar 18 and the squeegees 20, 22 in a timed sequence in accordance with the operating strokes of the apparatus 10. The printing squeegee 20 includes an elastomeric wiping blade 166 which is mounted on a support bar 168 which is connected to the box beam 170. The printing squeegee 20 has a raised position, which is shown in solid lines and a lowered position which is shown in broken lines 172. In the lowered position, the bottom edge 174 of the wiping blade 166 is in contact with the upper surface 176 of the printing screen 16. The box beam 170 is connected to the plate 178 which, in turn, is supported by the links 180, 182. The links 180, 182 are pivotally mounted on the carriage plate 184 by bearings 186 and 188. The plate 178 is connected to the links 180, 182 by the bearings 190, 192. The links 180, 182 are also pivotally connected to the floodbar plate 194 by means of the bearings 196 and 198. The floodbar 18 is connected to the box beam 200 which is connected to the floodbar plate 194. The links 180, 182 are capable of pivotal motion as indicated by the arrows 202 and 204. When the printing squeegee 20 is in the raised position, the floodbar 18 is in the lowered position, indicated by the solid lines, and the lower edge 206 of the floodbar 18 rests upon the upper surface 176 of the printing screen 16. When the printing squeegee 20 is in the lowered position, indicated by the broken line 172, the floodbar 18 is in the raised position, indicated by the broken lines 208.

An actuator bar 210 is carried by and projects downwardly from the central portion of the lower link 182 and has a raised position shown in solid lines and a lowered position shown in broken lines 212.

The excess ink squeegee 22 is mounted on the box beam 214 which is mounted on the plate 216, while the plate 216 is mounted on the pivot plate 218 by means of a screw 220 and a pin 222 which rides in a slot 224. The pivot plate 218 is pivotally connected to the upper link 226 by means of the pin 222 which rides in a bushing 228 (FIG. 6) and is pivotally connected to the lower link 230 by means of a pin 232. The upper link 226 is pivotally connected to the carriage plate 184 by a bushing 234 and a screw 236, as is shown in FIG. 6. The lower link 230 is pivotally connected to the carriage plate 184 by the bearing 238. The end 240 of the lower link 230 includes a slotted portion 242 which rides on a pivotally mounted block 244 which is connected to the plate 178 by the bearing 246. The excess ink squeegee 22 is generally similar to the printing squeegee 20 and includes an elastomeric wiping blade 248 which is mounted on a support bar 240; the support bar 250 being mounted on the box beam 214.

When the printing squeegee 20 is in the raised position, pivoting block 244 forces the end 240 of the lower link 230 upwardly and the excess ink squeegee 22 is moved to the lowered position, shown in solid lines in FIG. 4. In the lowered position, the bottom edge 252 of the wiping blade 248 is in contact with the upper surface 176 of the printing screen 16. When the printing squeegee 20 is in the lowered position, the pivoting block 244 forces the end 240 of the lower link 230 downwardly and the excess ink squeegee 22 is moved to the raised position shown by broken lines 254.

The carriage plate 184 is guided by a guide roller 256 which is mounted on a bracket 258 and which rides on the horizontal surface 260 of the guideway 262; and by the roller 264 which is mounted on the bracket 266 and which rides on the vertical surface 268 of the guideway 262. The actuating mechanism 164 is controlled by a timing and control mechanism of the apparatus 10 which is conventional in nature and which is not shown in detail. The actuating mechanism 164 is controlled in the preferred embodiment by connection of the actuator bar 210 with a chain drive 270 which moves the actuator bar 210 to the raised or lowered positions.

FIG. 4 shows the various elements in the positions in which they are found when the printing carriage 12 and the pressure roller 272, which supports the cleaning belt 274, are moving or are about to move in the direction shown by the arrow 276. The details of construction of the pressure roller 272 and the cleaning belt assembly 24 are best shown in FIGS. 5 and 6.

Figure 5:
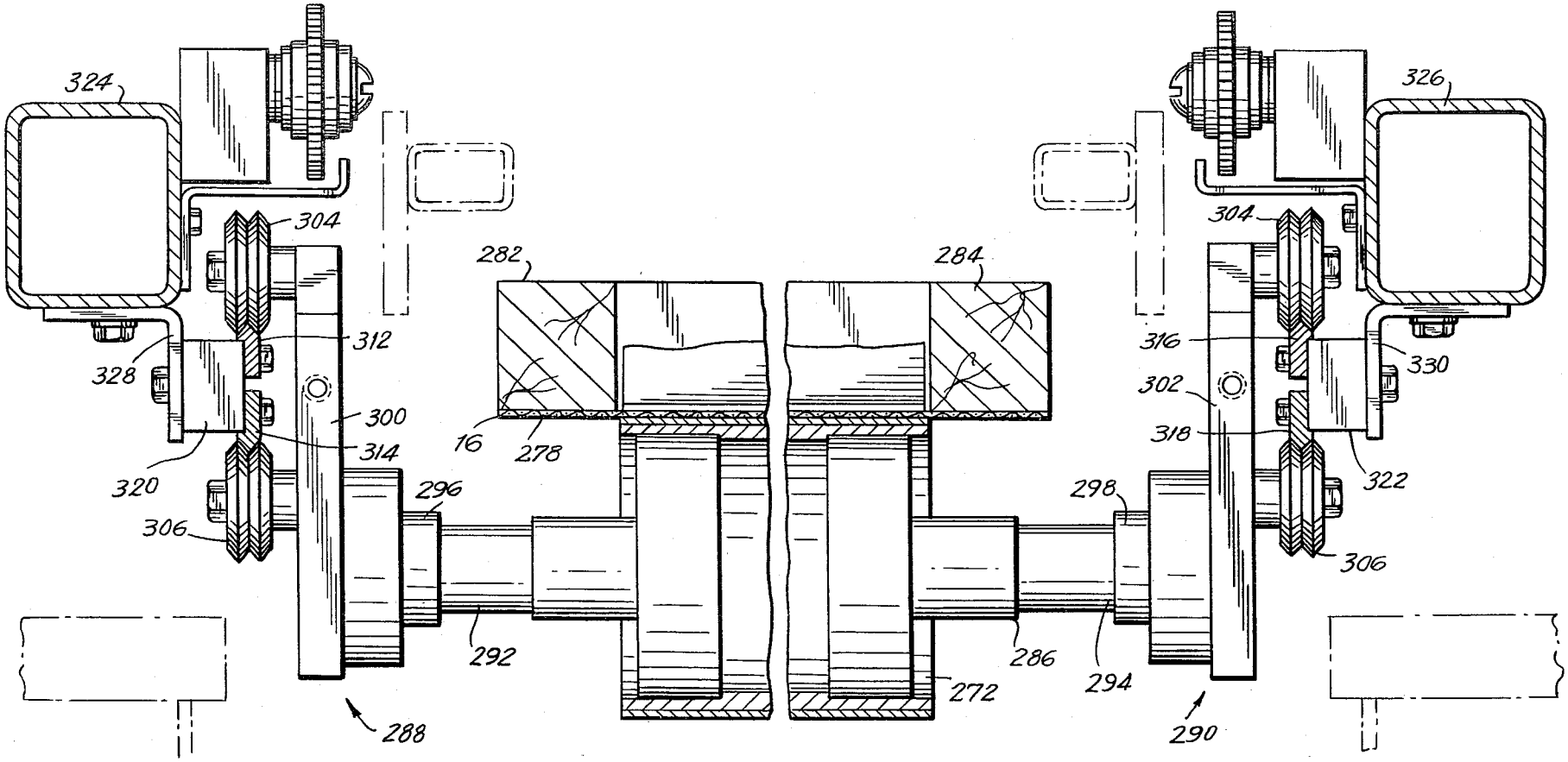
FIG. 5 is a transverse cross sectional view taken along the line 5—5 of FIG. 4.
Figure 9:
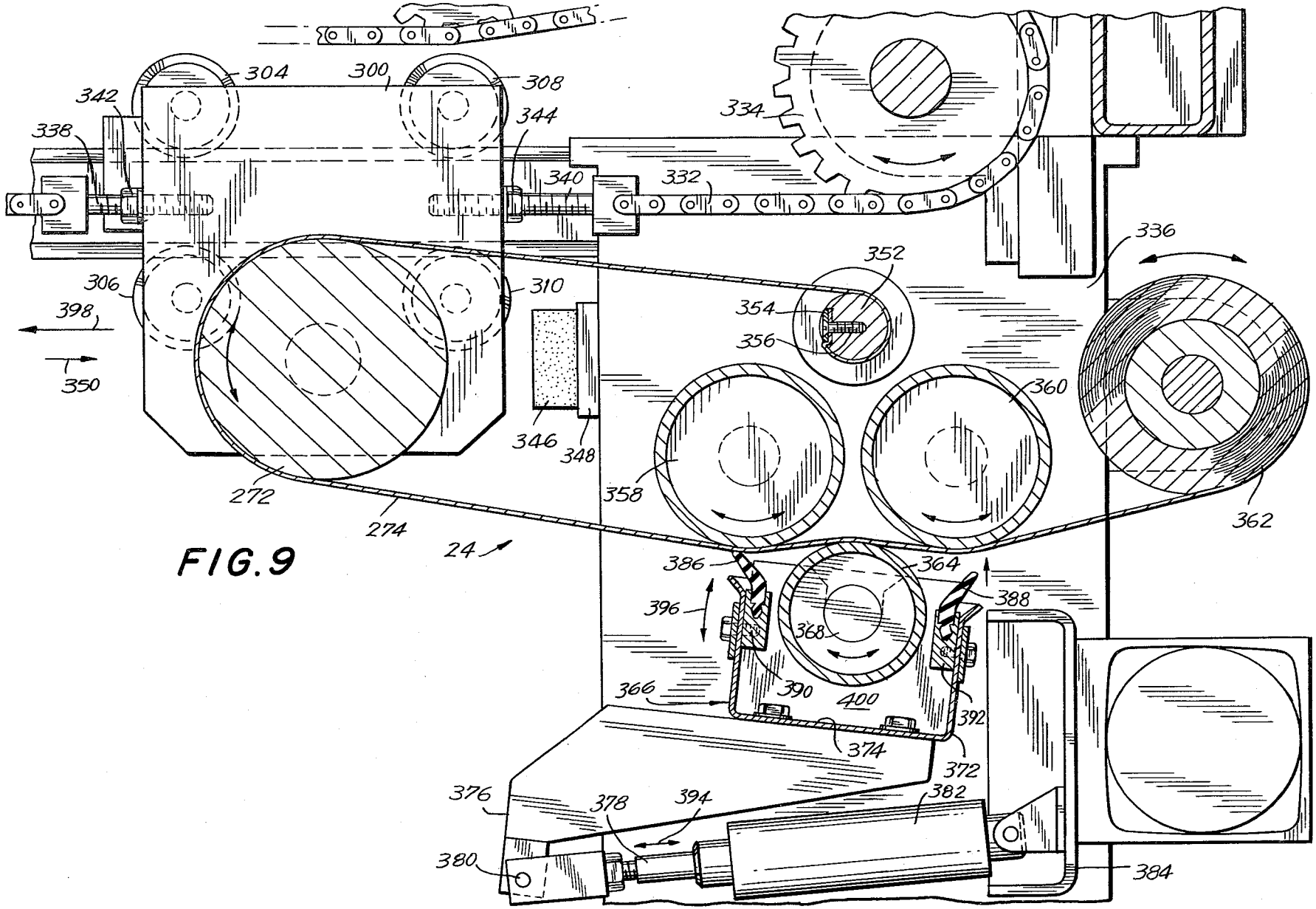
FIG. 9 is a fragmentary side elevation view, partially in section, showing the cleaning belt carriage.

As is illustrated in both FIGS. 4 and 5, the pressure roller 272 supports the cleaning belt 274 proximate to the lower surface 278 of the printing screen 16. The printing screen 16 is mounted on a rectangular frame 280, as is shown in FIG. 1. The longitudinal members of the frame 280 are indicated in FIG. 5 by the reference numerals 282 and 284. The pressure roller 272 is mounted on a shaft 286 which is supported by a pair of support assemblies 288, 290 which are generally similar but of opposite hand. The ends 292, 294 of the shaft 286 are rotationally mounted in bearings 296, 298 which are mounted on the support plates 300, 302. The support plates 300, 302 are each supported and guided by four rollers 304, 306, 308, 310, as shown in FIG. 9. The rollers 304, 306, as shown in FIG. 5, are mounted on guide rails 312, 314, 316, 318 which are, in turn, mounted on the bars 320, 322. The bars 320, 322 are mounted on the box beams 324, 326 by means of the brackets 328, 330. The support plates 300, 302 are driven along the guide rails 312, 314, 316, 318 by the roller chain 332 and sprocket wheel 334, as shown in FIG. 9. The sprocket wheel 334 is mounted on the frame plate 336 and the roller chain 332 is connected to the support plate 300 by the threaded rods 338, 340 which are threaded into the support plate 300 and maintained by the locknuts 342, 344. The threaded rods 338, 340 facilitate adjusting of the position of the support plate 300 in the horizontal direction.

An elastomeric pad 346 is mounted on the block 348 which is secured to the plate 336. The elastomeric pad 346 absorbs the impact of the support plate 300 when the pressure roller 272 and support plate 300 move in the direction shown by the arrow 350.

The overall arrangement of the various components of the cleaning belt assembly 24 is best shown in FIG. 9. The cleaning belt assembly 24 includes a belt bar 352 which is supported by the frame plate 336 and on which the cleaning belt 274 is connected by means of a plate 354 and a plurality of screws 356. The cleaning belt 274 passes over the pressure roller 272 and under a pair of doctor rollers 358, 360 which are rotationally mounted on the frame plate 336 and the cleaning belt 274 is then wound onto a wind-up roller 362 which is supported by the frame plate 336 and which is driven by an air or hydraulic motor in a manner which will be presently described.

A cleaning roller 364 is rotationally mounted on the frame plate 336 and is disposed so that the upper surface of the cleaning roller 364 projects upwardly slightly past an imaginary line drawn connecting the lowest surfaces of the doctor rollers 358, 360. The cleaning belt 274 passes over the cleaning roller 364 and because of the location of the upper surface of the cleaning roller 364, a portion of the cleaning belt 274 is forced to wrap partially around the cleaning roller 364. A cleaning trough or tank 366 is pivotally mounted on the shaft 368 of the cleaning roller 364 and includes a pair of side walls 370, 372 and a bottom portion 374 which is mounted on a plate 376 pivotally connected to an actuator shaft 378 by a pin 380. The body of the actuator 382 is pivotally connected to a bracket 384 which is mounted on the frame plate 336. A pair of elastomeric doctor blades 386, 388 are mounted in bars 390, 392 which are mounted on the upper portions of the side walls 370, 372, respectively. When the actuator shaft 378 moves in the directions shown by the double arrow 394, the cleaning tank 366 pivots in the directions shown by the double arrow 396. The doctor blades 386, 388 are proportioned so that when the cleaning tank 366 is pivoted, as is shown in FIG. 9, the doctor blade 386 bears against the lower surface of the cleaning belt 274 and urges the cleaning belt 274 against the doctor roller 358. When the cleaning tank 366 pivots in the opposite direction, the doctor blade 388 bears against the lower surface of the cleaning belt 274 and urges the cleaning belt 274 against the doctor roller 360. As the support plate 300 moves in the direction shown by the arrow 398, the cleaning belt 274 is unwound from the windup roller 362 and the motion of the cleaning belt 274 causes the cleaning roller 364 to rotate and become moistened with a cleaning solution 400 which is placed in the cleaning tank 366. The cleaning solution 400 is deposited on the cleaning belt 274 and the action of the cleaning solution 400 and the doctor blades 386, 388 serve to remove excess ink from the cleaning belt 274.

As is shown in FIG. 1, the motion of the printing carriage assembly 12 and the cleaning belt assembly 24 are synchronized through the drive shaft 402 which is connected to the printing carriage drive chain 162 and the drive shaft 404 which is connected to the cleaning belt drive chain 334. The drive shafts 402, 404 are connected by a drive assembly 406 which includes a pair of drive gears 422, 424, an idler gear 426 and a clutch 428. The drive assembly 406 facilitates the various motions of the printing carriage assembly 12 and the cleaning belt assembly 24 which will be described hereinafter.

Figures 10, 11, 12, 13:
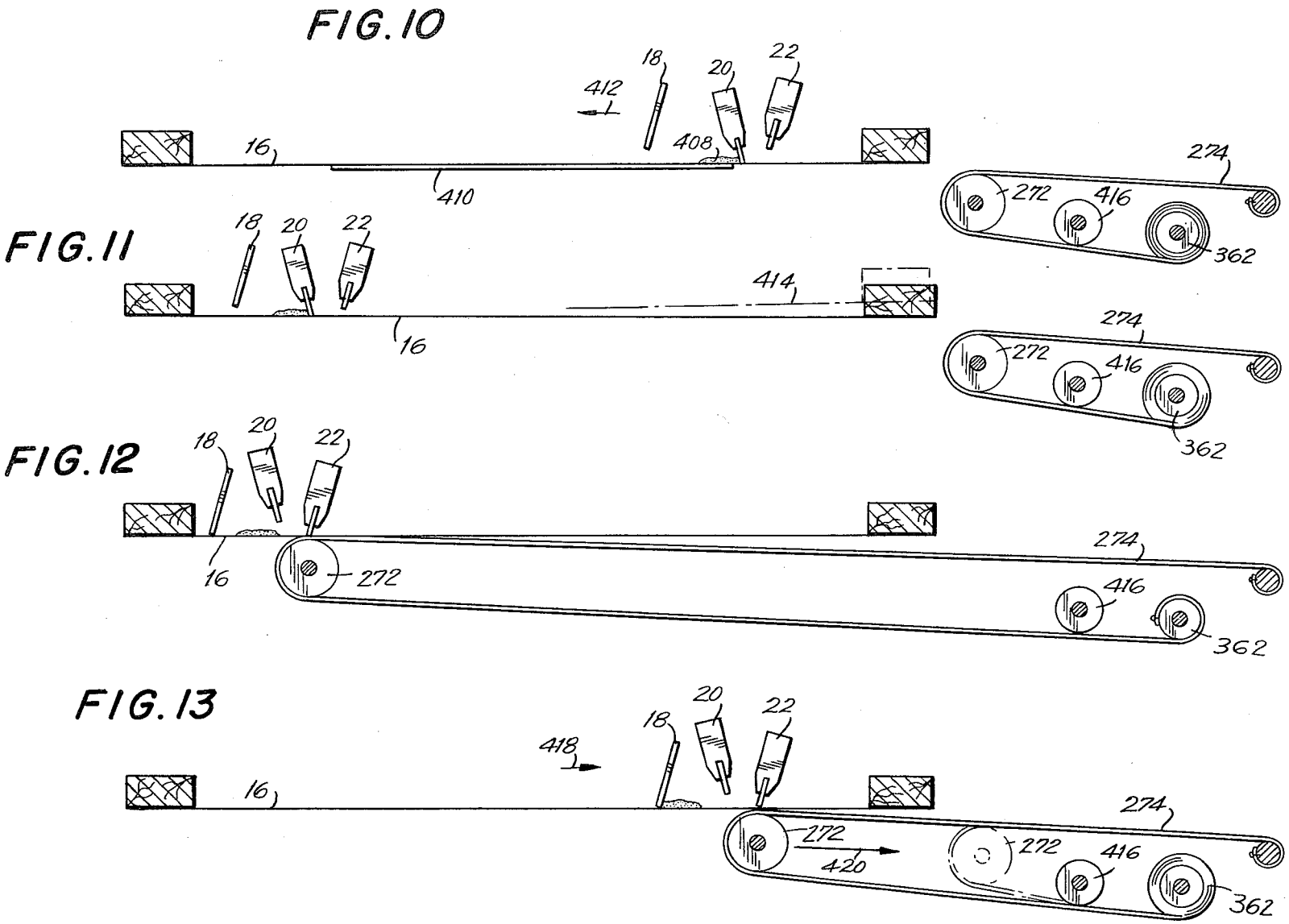
FIG. 10 is a schematic representation of the major operating elements of the apparatus with the apparatus shown at the start of the printing stroke, with the floodbar, the printing squeegee and the excess ink squeegee shown at the right end of the printing screen.
FIG. 11 is a schematic representation, similar to FIG. 10 with the apparatus shown at the end of the printing stroke and with the raised position of the printing screen shown in broken lines.
FIG. 12 is a schematic representation, similar to FIG. 10, with the apparatus shown at the start of the cleaning stroke which follows the printing stroke and with the cleaning belt in its unrolled position below the printing screen.
FIG. 13 is a schematic representation, similar to FIG. 10, with the apparatus shown near the completion of the cleaning stroke during which the excess ink squeegee is in contact with the screen and causes excess ink on the bottom surfaces of the printing screen to print onto the cleaning belt.

The operation of the apparatus 10 will be described with reference to FIG. 7, FIG. 8, FIG. 10, FIG. 11, FIG. 12 and FIG. 13. At the start of the printing stroke, the floodbar 18, the printing squeegee 20 and the excess ink squeegee 22 are disposed as shown in FIG. 10. The printing squeegee 20 is in contact with the printing screen 16 and the floodbar 18 and excess ink squeegee 22 are both raised. A quantity of ink 408 has been deposited to the left of the printing squeegee 20 by conventional inking means (not shown). The workpiece 410 which is to be printed is in place below the screen 16. During the printing stroke, the printing carriage 12 which supports the floodbar 18, the printing squeegee 20 and the excess ink squeegee 22 moves in the direction shown by the arrow 412.

As has been previously described, FIG. 7 shows an enlarged view of the edge portion 42 of the workpiece 410 during the printing stroke. The screen 16 has an open portion 40 through which ink may be forced by the printing squeegee 20 and which extends past the edge 46. As the ink is forced through the open portion 40 of the screen 16, a portion of ink 44 collects on the lower surface 48 of the screen 16.

FIG. 11 shows the apparatus 10 just after the completion of the printing stroke. The printing squeegee 20 is still in contact with the printing screen 16. The floodbar 18 and the excess ink squeegee 22 are still raised. The peeled or raised position of the screen 16 is shown in broken lines 414 and the workpiece 410 has been removed.

FIG. 12 shows the apparatus 10 at the start of the cleaning stroke. The floodbar 18 and the excess ink squeegee 22 are now in contact with the screen 16 and the printing squeegee 20 has been raised. The pressure roller 272 has moved to the left and is now directly below the excess ink squeegee 22. The movement of the pressure roller 272 has caused the cleaning belt 274 to unwind from the wind-up roller 362. As the cleaning belt 274 was unwound, it was cleaned by the doctor rollers 356, 360 and blades 386, 388, the operations of which have been previously described, and which are indicated in FIG. 10, FIG. 11, FIG. 12 and FIG. 13 diagrammatically by the single doctor roller 416.

FIG. 13 shows the apparatus 10 near the end of the cleaning stroke. The floodbar 18, the printing squeegee 20, the excess ink squeegee 22 and the pressure roller 272 are all moving to the right as is indicated by the arrows 418 and 420. During this stroke, the cleaning belt 274 has been brought close to the lower surface of the printing screen 16 and the excess ink squeegee 22 has printed the excess ink from the bottom surface of the screen 16 onto the cleaning belt 274. As the pressure roller 272 moves to the right, the cleaning belt 274 is cleaned by the cleaning assembly 24 and is re-rolled onto the wind-up roller 362. When the cleaning stroke has been completed, the pressure roller 272 returns to the position shown in broken lines and the floodbar 18 and excess ink squeegee 22 move upward and the printing squeegee 20 moves downward and the apparatus 10 is again ready for the next printing stroke, as shown in FIG. 10.

In accordance with the present invention, there is provided in addition to the apparatus described, a method for over the edge printing which includes the steps of providing a printing screen having selected clear portions, with the clear portions extending beyond the edges of a workpiece; positioning a workpiece beneath the printing screen, inking the screen and forcing the ink through the printing screen onto the workpiece, peeling the screen away from the workpiece and removing the workpiece, unrolling a cleaning belt below the printing screen and forcing the excess ink from the underside of the printing screen to print onto the cleaning belt and cleaning and re-rolling the cleaning belt.

Although the description of the apparatus has indicated that the object being printed is a glass blank, as previously described, the same has been done by way of example only. It is obvious that the apparatus 10, in accordance with the present invention, may be utilized for over the edge printing of virtually any flat or relatively flat object.

While I have shown and described the preferred embodiments of the present invention, it will be appreciated that the teachings herein will readily lend themselves to many modifications, changes, combinations and improvements by those skilled in the art, without departing or deviating from the present invention or the teachings hereof, as set forth in the appended claims.

What is claimed is:

1. A printing apparatus for printing on a surface of a workpiece comprising:

a support frame, screen printing means mounted on said support frame, said screen printing means having an upper and a lower surface, and cleaning means mounted on said support frame being positionally disposed adjacent said screen and adapted to clean said lower surface of said screen printing means with movement of said workpiece outwardly from under the printing screen means, wherein the cleaning means is a belt which has a portion thereof extended into contact with the underside of the screen printing means from said adjacent position and retracted back after cleaning.

2. A printing apparatus in accordance with claim 1, wherein said screen printing means is capable of a printing stroke and a non-printing stroke, and said cleaning means is operative during said non-printing stroke of said screen printing means.

3. A printing apparatus in accordance with claim 2, wherein said cleaning means comprises roller means rotatably mounted on said support frame, cleaning belt apparatus wound onto said roller means, unrolling means for unrolling said cleaning belt and extending the belt below and along said lower surface of said screening printing means, re-rolling means for re-rolling said cleaning belt apparatus onto said roller means, and said clean printing means being operatively disposed for printing upon said cleaning belt apparatus during said non-printing stroke to effectuate the cleaning of said lower surface of said screen printing means.

4. A printing apparatus in accordance with claim 3, including belt cleaning means mounted on said support frame and operatively disposed to clean said cleaning belt apparatus while the same is being unrolled from said roller means.

5. A printing apparatus in accordance with claim 3, including belt cleaning means mounted on said support frame and operatively disposed to clean said cleaning belt apparatus while the same is being re-rolled onto said roller means.

6. A printing apparatus in accordance with claim 3, including belt cleaning means mounted on said support frame and operatively disposed for cleaning said cleaning belt means during un-rolling of said cleaning belt apparatus from said roller means and for again cleaning said cleaning belt apparatus when the same is re-rolled onto said roller means.

7. A printing apparatus in accordance with claim 3, including belt cleaning means mounted on said support frame, said belt cleaning means including fluid reservoir means for storing a supply of cleaning fluid, and said cleaning belt apparatus being capable of being moistened by said cleaning fluid.

8. A printing apparatus in accordance with claim 3, including belt scraping means mounted proximate said cleaning belt apparatus for the purpose of removing residue therefrom.

9. In a screen printing apparatus having a printing screen mounted on a support frame, ink deposition means for depositing ink on the upper surface of said printing screen and printing squeegee means, the improvement comprising cleaning means mounted on said support frame and operatively disposed adjacent said screen and adapted to clean the lower surface of said printing screen with movement of a workpiece outwardly from under the printing screen wherein the cleaning means is a belt which has a portion thereof extended into contact with the underside of the screen printing means from said adjacent position and retracted back after cleaning.

10. The improvement in accordance with claim 9, wherein said cleaning means comprises cleaning belt means mounted on a movable support, said movable support being removably positionable below said printing screen, and excess ink squeegee means being operatively disposed to print excess ink onto said cleaning belt means to thereby clean said printing screen.

11. A printing apparatus for over-the-edge printing on a surface of a workpiece comprising:

(a) a support frame, (b) screen printing means mounted on said support frame, (c) means for moving a workpiece into a position beneath said screen printing means for printing and away from said screen printing means after printing, (d) means to apply a printing material to said screen printing material, and (e) means to remove excess printing material from said screen printing means:

1. cleaning means disposed adjacent to said screen and moveable concomitantly with movement of the workpiece away from the screen printing means to a position directly beneath said screen printing means, wherein the cleaning means is a belt which has a portion thereof extended into contact with the underside of the screen printing means from said adjacent position and retracted back after cleaning, 2. means to transfer the excess printing material from said screen printing means to said cleaning means, and 3. means to remove the excess printing material from said cleaning means.

12. A printing apparatus as claimed in claim 11 wherein the excess printing material transfer means is a squeegee.

13. A printing apparatus as claimed in claim 11 wherein the means for removing the excess printing material from the cleaning means is a doctor blade.

14. A printing apparatus as claimed in claim 11 wherein said belt is wound on a roller and includes means for unrolling said belt from said roller and positioning the belt beneath the screen printing means when the workpiece is moved away from the screen printing means.

15. A printing apparatus as claimed in claim 14 including means to re-roll the belt onto said roller before another workpiece is positioned beneath said printing means.

* * * * *